US006169369B1

(12) United States Patent
Nerone et al.

(10) Patent No.: US 6,169,369 B1
(45) Date of Patent: Jan. 2, 2001

(54) LOW COST, PRECISION ELECTRONIC STARTER

(75) Inventors: Louis R. Nerone, Brecksville; Mircea Voskerician, Cleveland; Laszlo S. Ilyes, Richmond Hts., all of OH (US)

(73) Assignee: General Electric Company, Schenectady, NY (US)

( * ) Notice: Under 35 U.S.C. 154(b), the term of this patent shall be extended for 0 days.

(21) Appl. No.: 09/408,216

(22) Filed: Sep. 29, 1999

(51) Int. Cl.[7] ..... H05B 41/14

(52) U.S. Cl. ..... 315/106; 315/99; 315/101; 315/DIG. 7

(58) Field of Search ..... 315/101, 102, 315/106, 107, 103, 99, DIG. 7

(56) References Cited

U.S. PATENT DOCUMENTS 5,233,273 * 8/1993 Waki et al. ..... 315/224

* cited by examiner

*Primary Examiner*—David Vu

(74) *Attorney, Agent, or Firm*—Fay, Sharpe, Fagan, Minnich & McKee, LLP

(57) ABSTRACT

Provided is a lighting circuit (10, 100, 160) which includes a line voltage source 12 used to supply a full wave signal 72 to circuit 10. A ballast 14 is connected to the line voltage source 12, and a lamp 16. Further included in the circuit (10, 100, 160) is an electronic starter (18, 102, 159) which is connected across the lamp 16. Electronic starter (18, 102, 159) includes a pulse generating circuit ((60, 62, 64) (108, 110, 112, 152, 154)), a switch (30, 120) which is connected to provide a cathode current pulse 74 to first and second cathodes (22, 26) of the lamp 16, generated by the pulse generating circuit. The pulse generating circuit and switch operate in such a manner that the pulse generating circuit limits the duration of the cathode current pulse 74 which is delivered to cathodes 22 and 26. A feedback or pulse timeout circuit (116, 118, 120, 121, 128, 130) may also be used to sense a current delivered to cathodes 122, 126 by cathode current pulse 74. Upon sensing a current value at least equal to a predetermined value, the feedback circuit acts to disable electronic starter (102, 159). Inclusion of the feedback circuit provides for precise control of energy being delivered to lamp 16. A shutdown circuit (52, 54, 56, 58) (114, 122, 124, 146) may be used to disable the electronic starter (18, 102) after a predetermined event.

20 Claims, 5 Drawing Sheets

| | | | | | |
|---|---|---|---|---|---|
| 162 | -16°C<br>120V/4<br>Strks/3s<br>108V/7<br>Strks/5s<br>96V No start | | 120V/60Hz<br>ADVANCE<br>BALLAST WITH<br>GLOW BOTTLE | | +110°C<br>120V/5 Strks/3s<br>108V/8 Strks/5s<br>96V/15 Strks/7s |
| 164 | -16°c<br>120 & 108V<br>Starts<br>96V No start | -10°C<br>120 & 108 & 96v<br>Starts | 120V/60Hz<br>ADVANCE<br>BALLAST WITH<br>ELECTRONIC<br>STARTER | +95°C<br>120 & 108 &<br>96V Starts | +100°C<br>120V No start |
| 178 | -20°C<br>230 & 220V<br>Starts<br>207V No start | -12°C<br>230 & 207 & 197V<br>Starts<br>184V No start | 230V/50Hz<br>TRIDONIC<br>BALLAST WITH<br>ELECTRONIC<br>STARTER | +95°C<br>230 & 207 &<br>184V Starts | +100°C<br>230V No start |
| 180 | -22°C<br>277 & 257V<br>Starts<br>250V No start | -16°C<br>277 & 250 & 221V<br>Starts | 277V/60Hz<br>ROBERTSON<br>BALLAST WITH<br>ELECTRONIC<br>STARTER | +95°C<br>277 & 250 &<br>221V Starts | +100°C<br>277&250V Starts<br>221V No start |
| 182 | -20°C<br>277V/7<br>Strks/4s<br>250 No start | -12°C<br>277V/5<br>Strks/2s<br>250V/16<br>Strks/5s<br>221V/42<br>Strks/11s | 277V/60Hz<br>ROBERTSON<br>BALLAST WITH<br>GLOW BOTTLE | +110°C<br>277 & 250 &<br>Starts | +120°C<br>277V/4 Strks/2s<br>250V/6 Strks/4s<br>221V/11 Strks/6s |
| 184 | -20°C<br>230V/7Strks/4s<br>207V/Flickers<br>NO START | | 230V/50Hz<br>TRIDONIC<br>BALLAST WITH<br>GLOW BOTTLE | | +120°C<br>230V/5 Strks/3s<br>207V/6Strks/4s |

Fig. 5

LOW COST, PRECISION ELECTRONIC STARTER

BACKGROUND OF THE INVENTION

The present invention is directed to starting of gas discharge lamps, and more particularly to an electronic starter for starting such lamps.

Existing electronic starters have conventionally been expensive compared to alternative starting devices such as glow bottle starters. Further, end-of-life protection provided in existing electronic starters is less than desirable, commonly, such starters pulse a lamp several times causing an undesirable visible flicker prior the lamp starting. The present invention overcomes the above noted shortcomings and other deficiencies of existing electronic starters by providing an electronic starter which allows for instant starting of lamps, improves end-of-life protection, and is configured inexpensively.

SUMMARY OF THE INVENTION

In a lighting circuit having a voltage line source, an electromagnetic ballast and a lamp, also provided is an electronic starter of the present invention. The electronic starter includes a switch, pulse generating circuit, and a pulse time-out circuit. The pulse generating circuit is used to generate a lamp start pulse, which is delivered to the switch connected to first and second cathodes of the lamp. The pulse time-out circuit is connected to the pulse generating circuit, and limits the number of the lamp start pulses delivered to the cathodes of the lamp.

A feedback circuit is provided which includes a sensor device to sense the lamp start pulse delivered to the lamp. The sensor device provides the sensed value to a feedback switch which acts to disable the electronic starter when a predetermined current value is sensed.

The electronic starter is configured with a shutdown circuit, and a shutdown timer network. The shutdown circuit disables the electronic starter after a predetermined interval, based on the configuration of the shutdown timer network.

BRIEF DESCRIPTION OF THE DRAWINGS

FIG. 5 provides a matrix comparing operation of the second electronic starter with existing glow bottle starters.

DETAILED DESCRIPTION OF THE PREFERRED EMBODIMENT

Figure 1:
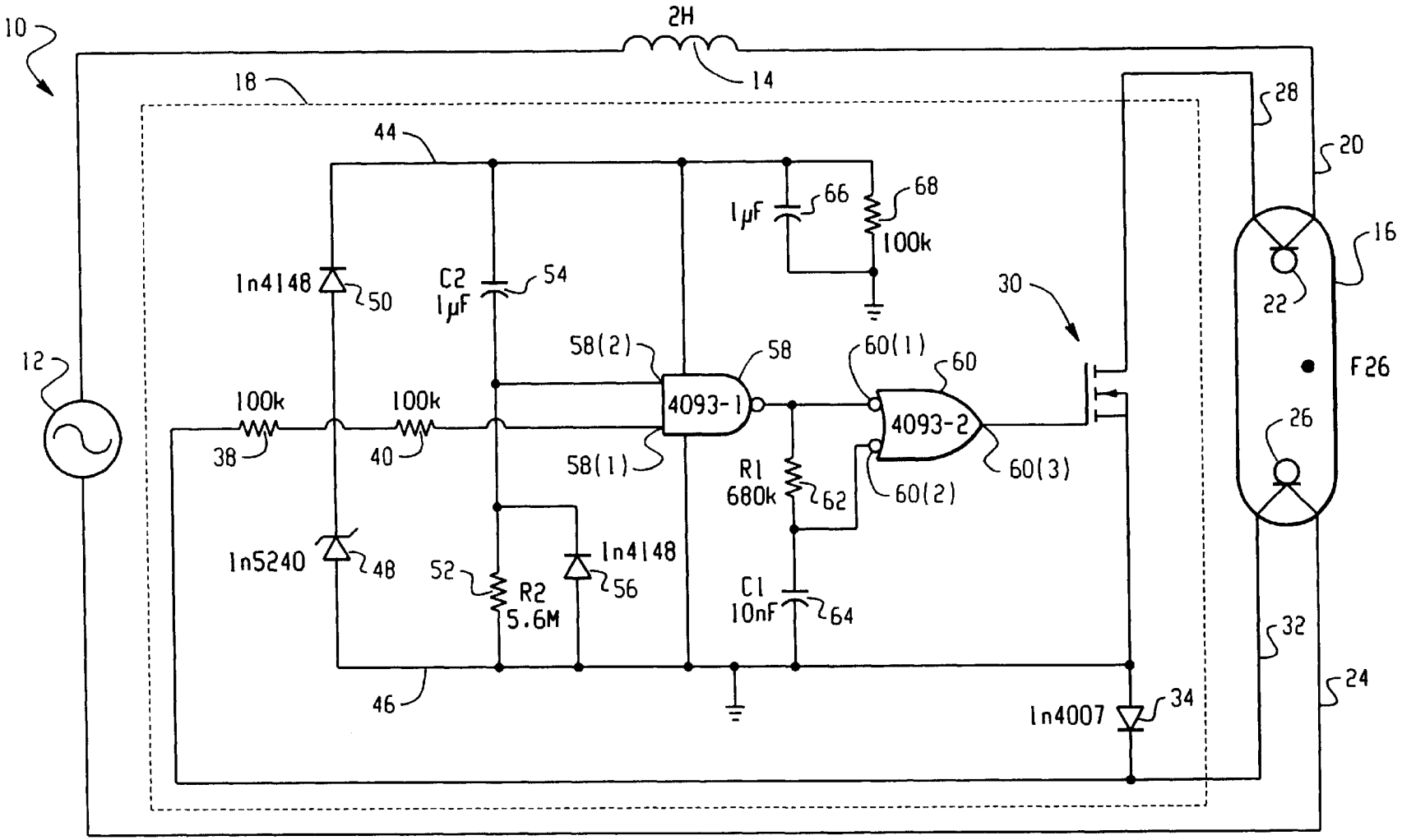
FIG. 1 illustrates a lighting circuit incorporating a first embodiment of the electronic starter of the present invention.

FIG. 1 illustrates a lighting system 10 having line voltage source 12, ballast 14, lamp 16, and electronic starter 18. Line voltage source 12 may be one of a number of voltage sources including, but not limited to a 120 v/60 Hz, 277 v/60 Hz, 230 v/50 Hz, and 347 v/60 Hz systems. Ballast 14 may be one of a number of different electromagnetic ballasts, including auto transformers, designed to operate in conjunction with line voltage source 12 and, may be considered for purposes of this discussion as a two-henry element. Lamp 16 is a gas discharge lamp, and in this embodiment is considered a 26 watt fluorescent lamp, although other discharge lamps of different type and values may also be implemented with the present invention.

Electronic starter 18 is designed to operate in a half-wave rectifying mode, and operates as an instantaneous type starter whereby lamp 16 will typically be started within 750 ms from activation of lighting circuit 10.

Lamp 16 is a four-lead lamp, where a first outer lead line 20 extends from ballast 14 to a first cathode 22, and a second outer lead line 24 extends from line voltage source 12 to cathode 26. A first inner lead line 28 is connected between cathode 22 and a drain of transistor 30. A second inner lead line 32 is connected from cathode 26 to a connection point leading to rectifying/blocking diode 34, which in turn is connected to the source of transistor 30. Second inner lead line 32 is further connected to a series-connected pair of resistors 38 and 40. In the present embodiment, resistors 38 and 40 are shown as separate elements, however, the resistance of these elements may be provided in another arrangements.

Electronic starter 18 includes positive voltage bus 44 and common bus 46, wherein Zener diode 48 is connected in series with diode 50 between positive voltage bus 44 and common bus 46. Further connected between buses 44, 46 is a shutdown circuit (52, 54, 56, 58) which includes a shutdown timer network (52, 54, 56), wherein capacitor 54 is connected to resistor 52, which in turn is in parallel with diode 56. Resistors 38 and 40 are connected to a first input 58(1) of triggering/shutdown element 58, which may be a NAND gate on a 2 input, quad Schmitt Trigger chip. A second input 58(2) to shutdown element 58 is provided through shutdown timer network (52, 54, 56). The output of shutdown element 58 is delivered to a pulse generating circuit (60, 62, 64), through a first input 60(1) of pulse generating device 60, which may be arranged as an OR gate. A second input 60(2) of OR gate 60 is provided from a pulse time-out circuit (62, 64) consisting of resistor 62 and capacitor 64. The output of pulse generating device 60 is delivered to the gate of starter switch 30 which may, for example, be a FET. A bus filtering circuit (66, 68) is formed by the parallel relationship of capacitor 66 and resistor 68.

Figure 2:
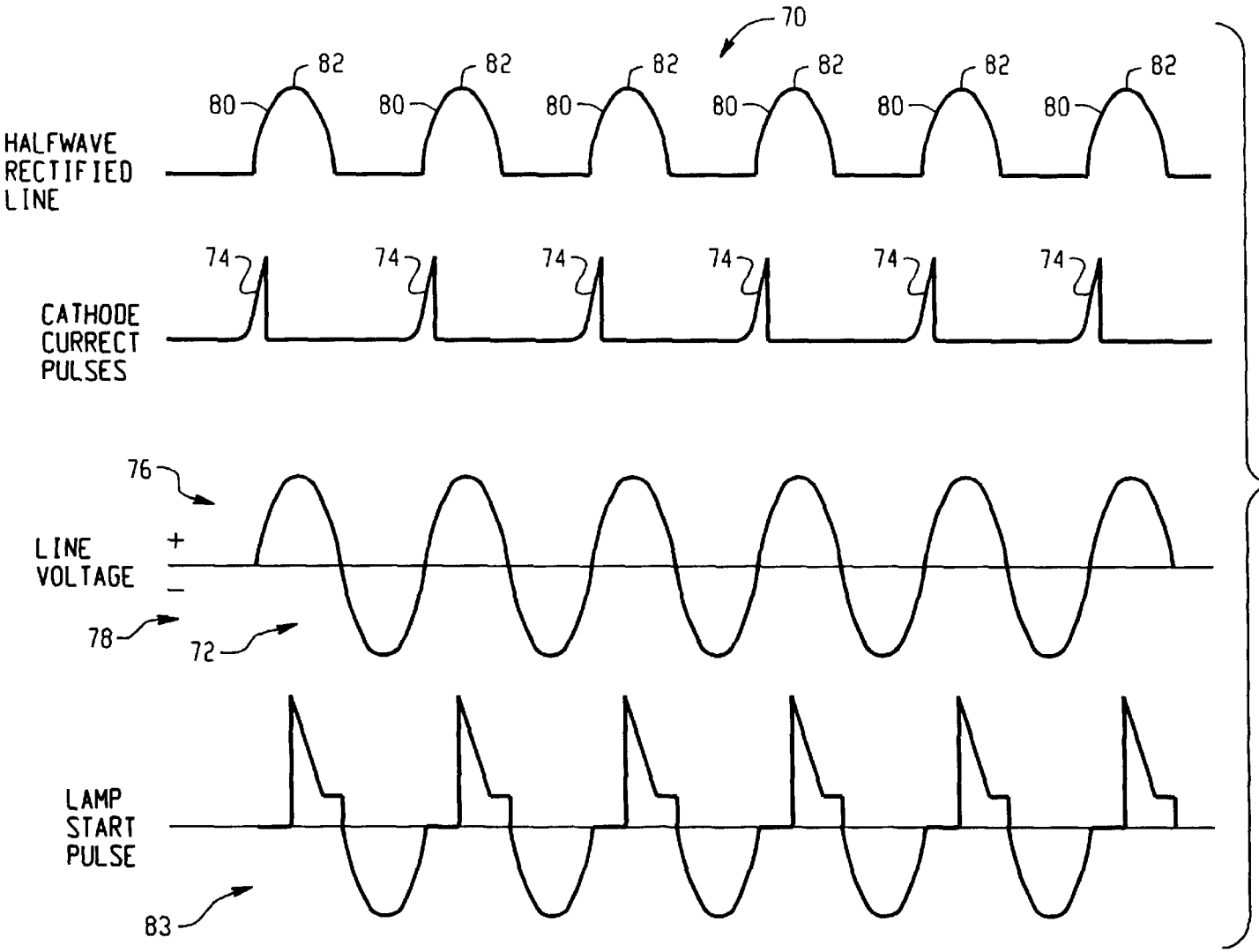
FIG. 2 illustrates various wave forms generated by the lighting circuit of the present invention.

FIG. 2 depicts a half-wave rectified pulse train 70, generated by electronic starter 18 from full wave signal 72 of line voltage source 12. Rectification of full wave signal 72 is accomplished by use of rectifying/blocking diode 34. Electronic starter 18 is designed so pulse train 70 continues until electronic starter 18 is automatically disabled. The disabling feature is incorporated into electronic starter 18 in order to control the number of attempts made to strike lamp 16. This design acts as a safety feature whereby uncontrolled striking of lamp 16 will not occur, in order to protect against damage to lamp 16 and its light fixture.

A cathode current pulse 74 is generated and delivered to lamp 16 during a positive going time period 76 of pulse train 70, and no pulses are delivered during a negative going time period 78. More particularly, cathode current pulse 74 will be delivered during a beginning portion 80 of the positive going time period 76.

It is not critical to strike lamp 16 with cathode current pulse 74 at peak 82 of the pulse train 70. While striking the lamp at peak 82 may optimize energy delivery, it has been found that lamp 16 will start even at minimal ranges of the positive period 76. It is to be understood that other embodiments can be designed for pulses to be delivered at negative going times of the full wave signal 72.

Returning attention to the operation of electronic starter 18, it is considered that lighting circuit 10 is unpowered, i.e. line voltage source 12 is disconnected from lighting circuit 10 by a switch or other mechanism. Upon initial energization, line voltage source 12 supplies power to electronic starter 18 causing first input 58(1) of NAND gate 58 to be driven high through resistors 38 and 40. Second input 58(2) is also driven high, since capacitor 54 is fully discharged and therefore appears as a short upon initial energizing of lighting circuit 10, causing second input 58(2) to be supplied by resistor 52. The two high inputs result in an initial low output from NAND gate 58, which is fed into inverting input 60(1) of OR gate 60.

Further action upon start-up includes driving a second input 60(2) of OR gate 60 low, since capacitor 64 is initially discharged thereby pulling input 60(2) low. Thus, OR gate 60, with inverted inputs, receives two low signals. These lows are converted to high signals by the inverting inputs of OR gate 60, resulting in a high state at output 60(3). This high output is delivered to the base of transistor 30, causing transistor 30 to turn on. However, fullwave signal 72 is in a negative half-cycle across electronic starter 18, then diode 34 is in a blocking mode, and no current flows through transistor 30.

It is appreciated that when full wave signal 72 is in a negative half cycle, and diode 34 is turned off, current is still able to flow through cathode 26, to positive voltage bus 44. Providing positive voltage bus 44 with energy to run CMOS logic devices, such as NAND gate 58 and OR gate 60.

When full wave signal 72 transitions from a negative half-cycle to a positive half-cycle, the output of NAND gate 58 is driven high since both inputs 58(1), 58(2) are no longer high. Particularly, input 58(1) will go low, since once diode 34 is no longer blocking, the voltage across resistors 38 and 40 will drop. This action drives first input 60(1) of inverted OR gate 60 low.

Driving the output of NAND gate 58 high does not immediately turn off signals produced by OR gate 60. Input 60(2) will still be low since capacitor 64 will not be sufficiently charged. Through the action of resistor 62, capacitor 64 charges up, and when a sufficiently high level is reached, input 60(2) will go high causing OR gate 60 to drop low, turning off FET 30 during that positive cycle of fullwave signal 72.

During the time capacitor 64 is charging, and the circuit voltage is in a forward direction across FET 30, and output 60(3) is high, then FET 30 conducts, and cathode current pulse 74 strikes cathodes 22, 26. At the instant when cathode current pulse 74 is completed, lamp voltage pulse 83 occurs to start the lamp. If lamp voltage pulse 83 is successful in starting the lamp, the voltage across starter circuit 18 will drop sufficiently low to prevent NAND input 58(1) from reaching a threshold value, effectively shutting down electronic starter from pulsing lamp 16.

If on the other hand, lamp voltage pulse 83 is not successful in igniting the lamp 16, then cathode current pulse 74 will continue to be repeated until either the lamp does start, or shutdown capacitor 54 attains a voltage which disables NAND gate 60. Cathode current pulse 74 will cut off once capacitor 64 has charged. This pulsing action will repeat as full wave signal 72 cycles between its positive and negative portions, until either timing capacitor 54 charges to a sufficiently high level to switch input 58(2) from a high to low, resulting in a permanent high output from NAND gate 58, or lamp 16 ignites. This results in a continuous low at inverted input 60(1). With capacitor 64 sufficiently charged so the inverted input 60(2) is also low, electronic starter 18 is disabled.

Therefore, a limited number of lamp starting pulses 74 are available from electronic starter 18 before operation of electronic starter 18 is automatically stopped.

Shutdown time-out circuit 52, 54 is configured so that once capacitor 54 has charged to a sufficient value it will pull input 58(1) low, and electronic starter 18 will be disabled until it is reset, such as removing the power supplied to circuit 10. Removing power from circuit 10 may, for example, be accomplished by turning a light switch off.

Pulse time out circuit (62,64) is responsible for generating the timed output of OR gate 60 to a high output so that OR gate 60 turns on FET 30 for only a portion of the positive part of full wave signal 72.

Upon deactivation of circuit 10, capacitor 54 discharges. Once the voltage line source 12 is removed, capacitor 54 quickly discharges through resistor 68 such that upon a restart (i.e. turning on a light switch) electronic starter 18 will again generate pulse train 70 previously described.

Zener diode 48 is used to regulate the bus of electronic starter 18 in order to maintain the bus at a desired voltage level such as 10 volts. Diode 50 is a fast-blocking diode.

From the foregoing discussion, it can be seen that electronic starter 18 operates in a half-wave mode as the voltage applied to lighting circuit 10 builds to its operating voltage. FET 30 is turned on during a negative half cycle of full wave signal 72, where diode 34 is in a blocking mode, so that no current will flow when FET 30 is switched on. When the alternate positive half cycle commences, FET 30 remains on thereby allowing the half-wave current to build through cathodes 22 and 26. At a point after the positive half cycle begins, the pulse generating circuit (60, 62, 64) causing FET 30 to shutdown.

A time constant, tau (t), which is equal to the values of resistor 62 times capacitor 64, is used to determine the amount of current which will flow through the lamp cathodes. As FET 30 turns off, the current ceases to flow causing FET 30 to avalanche. This results in the application of high voltage start pulses 83 to lamp 16. If lamp 16 fails to start, electronic starter 18 will continue to generate pulses of pulse train 70 until its pulse timer circuit (52, 54) disables NAND gate 58. Therefore, when lamp 16 fails to start within a predetermined time period, electronic starter 18 of the present invention is disabled. Selection of particular values for resistor 52 and capacitor 54 will determine the length of pulse train 70. In one embodiment resistor 52 and capacitor 54 are selected to provide a pulse train time-out period of ¾seconds.

Prior to ignition of lamp 16, pulse train 70 allows current to be drawn through cathodes 22 and 26 of lamp 16, although provision of such current has minimal heating effect on cathodes 22 and 26. As cathodes 22 and 26 draw current, the amount of energy it takes to start lamp 16 will diminish. Eventually, under normal operating conditions, one of a number of start pulses 83 will start lamp 16, when the disposition of the gas has reached a sustained discharge state. When the start of lamp 16 occurs, current is drawn directly through the lamp 16, essentially deactivating electronic starter 18 from circuit 10.

Electronic starter 18 may be designed for universal selection of line voltages, by taking into consideration operating temperatures of the lamps and line voltage variations which may be inherent to customer use. The operating parameters for starting a lamp such as lamp 16 are typically between −9° C. and +70° C. Therefore, component selection for electronic starter 18 needs to take into account operation and other temperature variations. Judicious selection of component values will allow the lamp to light well outside the typical specified temperature range of the product.

Below are component values and designations for electronic starter 18 of FIG. 1:

| | |
|---|---|
| Transistor 30 | 1N80; 800 V, MOSFET |
| Diode 34 | 1N4007; 1a, 1000 V |
| Resistor 38 | 100K ohms |
| Resistor 40 | 100K ohms |
| Zener Diode 48 | 1N5240; 10 V |
| Diode 50 | 1N4148 |
| Resistor 52 | 5.6M ohms |
| Capacitor 54 | 1 micro-farad |
| Diode 56 | 1N4148 |
| NAND Gate 58 | 4093-1 |
| OR Gate 60 | 4093-2 |
| Resistor 62 | 680K ohms |
| Capacitor 64 | 10 nano-farads |
| Capacitor 66 | 1 micro-farad |
| Resistor 68 | 100K ohms |

Figure 3:
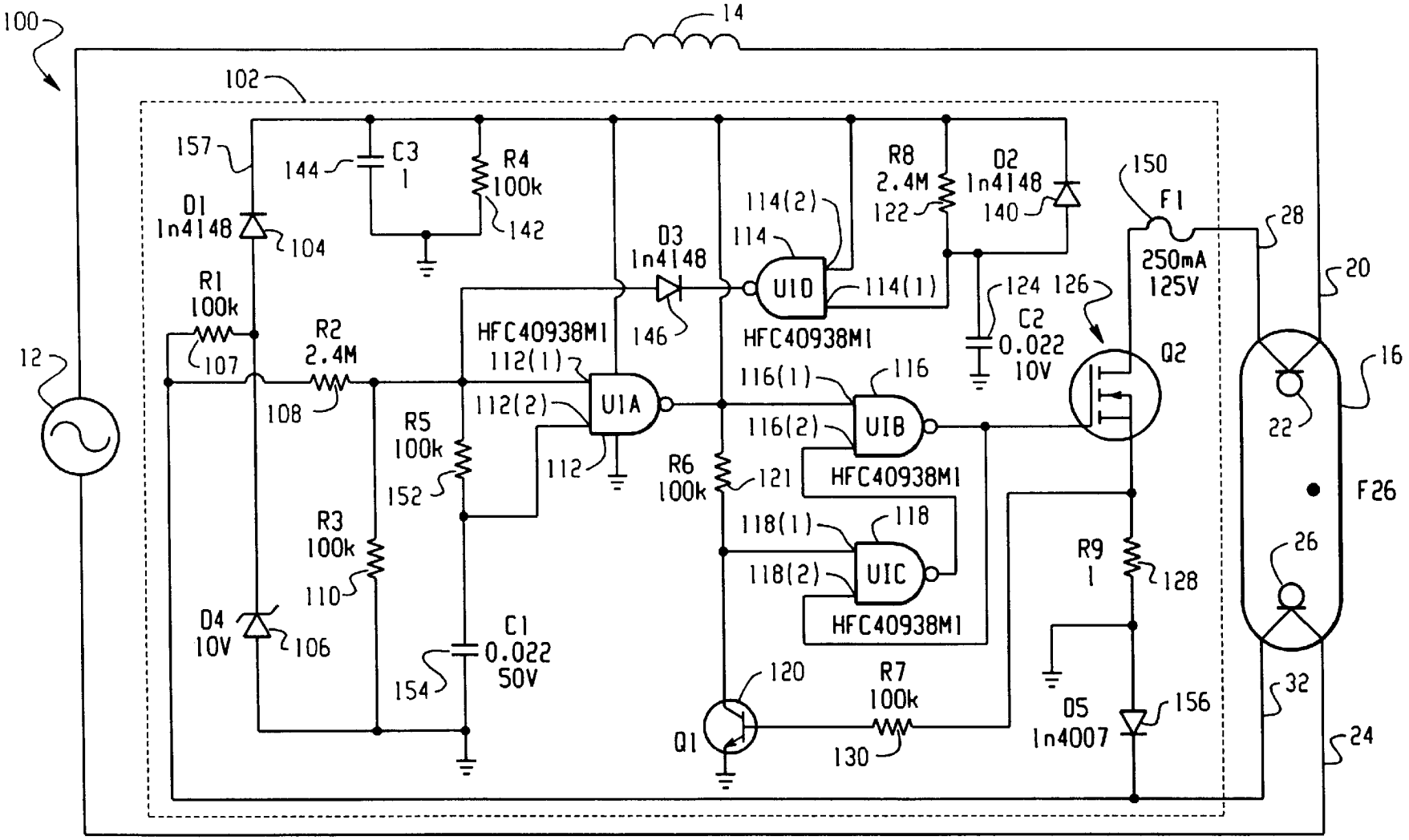
FIG. 3 depicts a lighting circuit incorporating a second embodiment of the electronic starter of the present invention.

Turning to FIG. 3, illustrated is a lighting circuit 100 incorporating line voltage source 12, ballast 14 and lamp 16 similar to FIG. 1. Also incorporated is an electronic starter 102 which is designed to provide precise control of current supplied to lamp 16, accomplished by use of feedback circuitry. In this embodiment, a divider network consisting of diodes 104 and 106 are connected to an input resistor 107. Further included as part of electronic starter 102 is a pulse generating circuit (108, 110, 112, 152, 154), a feedback pulse timeout circuit (116, 118, 120, 121, 128, 130), a shutdown circuit (114, 122, 124, 146), a discharge circuit (140, 142, 144), a switch (126), a rectifying/blocking diode 156, and a fuse element (150). The resistor network (108, 110) is used to drive the first input of a logic device such as a quad, two input Schmitt Trigger chip, represented by NAND gates 112, 114, 116 and 118. NAND gates 116 and 118 are configured in a latch design receiving an input from the output of NAND gate 112, and a feedback current delivered through BJT transistor 120. This transistor has its emitter connected to ground and its collector connected to the positive bus through resistor 121. A shutdown circuit of lighting circuit 100 is defined by resistor 122, capacitor 124 and NAND gate 114.

When latch circuit (116, 118) is enabled, a high signal is delivered from NAND gate 116 to the gate of FET 126. Similar to the discussion of FIGS. 1 and 2, a half-wave rectified pulse train 70 is generated. The rectification of a full wave signal 72 is achieved through use of rectifying/blocking diode 156. From pulse train 70, lamp starter pulse 74 is developed and delivered to lamp 16. However, in the present embodiment lamp starter pulse 74 is sensed by sense resistor 128 and base resistor 130 for feedback control.

The voltage across sense resistor 128 will be proportional to the amount of current being drawn by lamp 16, and the voltage developed across base resistor 130 is used for a base current to turn on transistor 120. The values of resistors 128 and 130 may be selected such that when the current through lamp 16 reaches a predetermined value, sufficient base current is provided through resistor 130, in order to turn on transistor 120. Since transistor 120 is tied to ground at its emitter, transistor 120 will be pulled to ground which acts to pull input 118(1) of NAND gate 118 low. This acts to reset the latch formed by NAND gates 116 and 118, thereby disabling electronic starter 102.

The preceding operation differs from electronic starter 18 of FIG. 1, in that once circuit 10 was activated, the amplitude of pulse 74 was determined only indirectly through a timer circuit (62, 64). In this embodiment latch (116, 118) is used to turn off FET 126 after a predetermined current level is sensed in lamp 16 allowing for precise control of the amount of current that flows through cathodes 22, 26. Thus, use of a feedback circuit consisting of resistor 128, resistor 130, transistor 120 and latch 116, 118 allows for precise control of the amount of energy delivered to lamp 16, which protects the FET 126.

The amount of current flowing through cathodes 22, 26 is controlled by adjusting the values of resistors 128 and 130. Increasing the value of resistors 128, 130, means transistor 120 will turn on at an earlier time period, resetting latch (116, 118), which terminates current pulse 74.

The shutdown circuit (114, 122, 124, 146), determines the number of current pulses which will occur during a starting time. It is desirable to control the number of lamp pulses 74 since repeated striking of cathodes 22, 26 may cause undesirable product failure due to heating of the lamp cathodes and ballast.

The design of electronic starter 102 removes the power supplied to circuit 100 after pulse train 70 has timed out, in order to re-enable electronic starter 102. This may be accomplished by simply turning a switch to the OFF position and then restarting circuit 100, by turning the switch to an ON position.

The design of electronic starter 102, also makes it desirable that capacitor 124 is not charged upon re-energizing lighting circuit 100, since circuit 100 would not attempt to restart. Therefore, circuit 100 includes discharge diode 140, which upon de-energizing of circuit 100 forms a path for capacitor 124 to discharge through discharge resistor 142 to ground, where capacitor 144 has a higher value than capacitor 124. This allows for a substantially immediate turn-on/turn-off switching action to start lamp 16.

Input resistors 107 and 108 are split apart to provide more flexibility to lighting circuit 100. In this embodiment, resistor 107 is used to limit the amount of current going into the positive bus to charge the circuit, and resistor 108 is selected to optimize the performance of the control elements, NAND gates 112, 114, 116, 118.

A fuse 150 is included in series with FET 126. Should FET 126 fail, causing a high current flow, fuse 150 will trip thereby preventing damage to circuit 100 including lamp 16, and the lighting fixture.

Turning attention to NAND gate 114, when circuit 100 is first energized, shutdown capacitor 124 is completely discharged. Therefore, input 114(1) of NAND gate 114 is initially pulled low, and input 114(2) is driven high as it is attached to the starter bus 160. The high-low combination causes output 114(3) to be high, which places diode 146 in a blocking state. Therefore input 112(1) of NAND gate 112 is allowed to freely change its state, on the negative half-cycles of the full wave signal 72.

Over a period of time, approximately a maximum 750 ms, shutdown capacitor 124 will sufficiently charge through shutdown resistor 122 to pull input 114(1) high. When inputs 114(1) and 114(2) are high, output 114(3) goes low, changing diode 146 from a blocking state to a passing state, which causes input 112(1) of NAND gate 112 to be pulled low for the remainder of time circuit 100 is on. The preceding action disables electronic starter 102. This state will continue until circuit 100 is powered down, and circuit 100 resets itself. By this operation, shutdown circuit prevents an excessive number of pulses 74 by FET 126. It is noted, FET 126 is pulsed by NAND gate 112, which is configured as an oscillator and is line-synchronized. Therefore NAND gate 112 is a synchronized pulse source that provides a pulse that is processed through latch (116, 118).

It can be appreciated that lighting circuit 100 operates conceptually in a similar manner as lighting circuit 10 of FIG. 1. However, electronic starter 18 of FIG. 1 controls the current through the cathodes by controlling the length of time current is applied to lamp 16. On the other hand the embodiment of FIG. 3 provides for direct control of the cathode current by obtaining a sensed current which controls operation of latch (116, 118). Latch (116, 118) is reset by activation of sense transistor 120, that senses the voltage developed across sense resistor 128. When voltage across sense resistor 128 reaches $V_{be}$, sense transistor 120 turns on, resetting latch (116, 118), which causes FET 126 to turn off.

Unlike the circuit of FIG. 1, the magnitude of the current is dependent upon the base emitter voltage of sense transistor 120, and the value of sense resistor 128. Therefore, circuit 100 will develop the same peak current through the cathodes independent of line voltage.

With continued attention to FIG. 3, starter bus 157 provides power to NAND gates 112, 114, 116, 118 to allow for a quick activation time. Therefore bus 160 is tied to resistor 107 and to line voltage source 12. On the other hand, the input to gate 112(1) of NAND gate 112, driven through resistor 108, requires less energy than needed to activate NAND gates 112, 114, 116, 118, therefore a larger resistance is provided for resistor 108, than the resistance of resistor 107. Resistor 108 is then tied to ground through resistor 110. In this manner, a positive voltage may be applied to gate 112(1), but a significant less amount of current is drawn.

Diode 156 acts as a blocking/rectifying diode, similar to diode 34 of FIG. 1.

Electronic starter 102 includes a pulse generating circuit (108, 110, 112, 152, 154) comprised of a logic device 112 such as a NAND gate, and a pulse timing circuit with resistor 152 and capacitor 154 for generating a lamp start pulse 74. A shutdown circuit (114, 122, 124, 146) has a logic device 114 such as a NAND gate, and a shutdown timing network comprised of resistor 122 and capacitor 124. The shutdown circuit (114, 122, 124) is connected to the pulse generating circuit, whereby the pulse generating circuit (108, 110, 112, 152, 154) acts to limit duration of the lamp start pulse 74 delivered to the cathodes 22, 26 and disable electronic starter 102 after a predetermined event, such as a high current to cathodes 22, 26.

The embodiment of circuit 100 includes electronic starter 102 incorporating a shutdown circuit (114, 122, 124, 146). It is to be appreciated that the operation of an electronic starter according to the concepts of the present invention may be configured to operate without such a shutdown mechanism.

Figure 4:
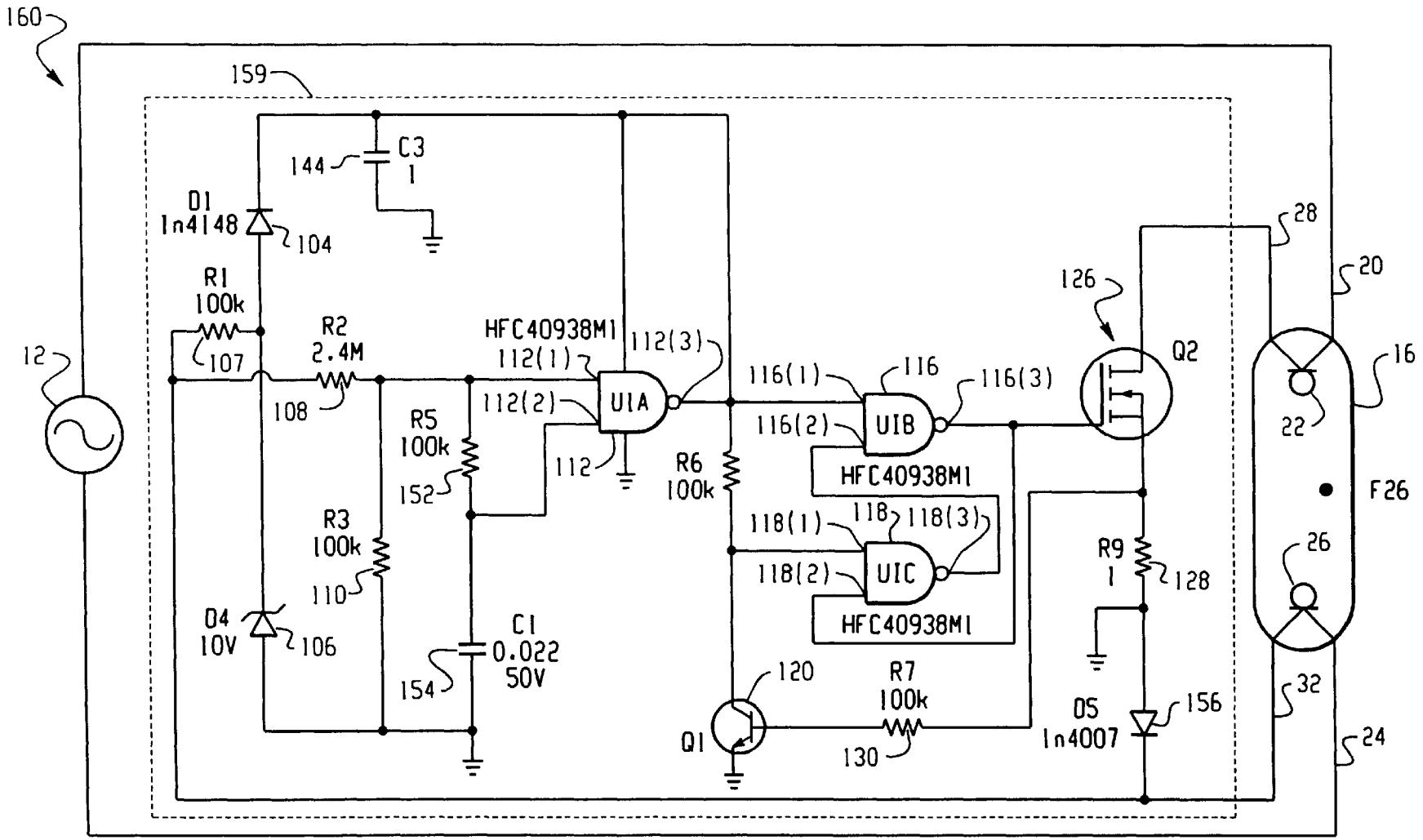
FIG. 4 shows a lighting circuit incorporating a third embodiment of the electronic starter according to the present invention.

In particular, such an electronic starter 159 is incorporated into lighting circuit 160 shown in FIG. 4. It is noted that elements which are the same as provided in electronic starter 102 of FIG. 3 are maintained with the same numbering system.

With attention to operation of this device, at the onset of a first negative half-line cycle, input 112(1) of NAND gate 112 is moved to a high (true) condition. As capacitor 154 charges through resistor 152, input 112(2) also eventually is moved to a high (true) state, dropping output 112(3) low. This action sets the latch (116, 118) (e.g. a S-R NAND latch), of the current feedback circuit to a high-state through input 116(1) of NAND gate 116. While the output from the feedback circuit remains high, switch 126 is activated. However, due to the use of blocking diode 156, no current will flow through switch 126 at any time during the negative half-cycle. The delay provided by capacitor 154 and resistor 156 prevents false triggering of latch (116, 118) and switch 126.

At the onset of a positive half-cycle, input 112(1) of NAND gate 112 of the pulse generating circuit, drops low. This does not immediately change the state of the pulse time-out circuit, particularly latch (116, 118) is maintained, since at the time of switching input 118(1) is high due to the action of pull-up resistor 121. As a result, current will begin to flow through switch 126, and consequently through lamp cathodes 22, 26. As the current increases, the voltage across a sensing resistor 128 will also increase.

Once the voltage across sensing resistor 128 exceeds a base emitter voltage of transistor switch 120, switch 120 will turn on, pulling input 118(1) of NAND gate 118 low. This resets the pulse time-out circuit (116, 118, 120, 121, 128, 130), and interrupts the current in switch 126. Due to the large inductance of the fluorescent ballast 14, a high voltage, limited by the avalanche voltage of switch 126, is developed across lamp 116, causing a discharge gas of the lamp to break down. Sustaining the discharge, will result in a voltage between cathodes 22 and 26 collapsing. Thus by proper selection of resistor 108 and 110, the voltage on input 112(1) of NAND gate 112 will be below a threshold voltage of the logic circuit. This will effectively disable electronic starter 159 from providing any additional starting pulses to lamp 116 if the discharge is not sustained, the entire process described above is repeated until the lamp will light, i.e. the gas discharge becomes self-sustained.

Lead connectors 20, 24, 28, 32, or resistor 128, or a PCB trace may also be made fusible to protect against high temperature failure. It is to be noted that each of the other circuits described in the foregoing may also be provided with such protection, where appropriate.

It is to be appreciated that electronic starter 18 of FIG. 1 may also be designed such that it operates without the shutdown circuitry.

Applying power to ballast 14, of lighting circuits (10, 100, 160) incorporating electronic starters (18, 102, 159) results in an instant start of lamp 16. Even though lamp 16 may be pulsed several times using these starters, the pulses occur at a high frequency which generally prevents the detection of flicker.

The foregoing described electronic starters, allow for robust, flicker-free operation for universal line voltage and widely ranging temperatures. The starters are designed for instant start of lamps and may be used with plug-in lamp products. The design also eliminates undesirable failure of the lamp, starter and cathodes.

It is also noted that each embodiment introduces a 2-leaded starter circuit which makes it more amenable for manufacturing, and unlike glow bottle starters, which are mildly radioactive, this is not a concern with the described embodiments.

With further attention to operation of electronic starter 102, various tests were taken using a glow bottle starter for specific electromagnetic ballasts at specific temperatures in comparison to the same ballast being operated by electronic starter 102 of the present invention. The results of such tests are set forth in FIG. 3.

Rows 162 and 164 list the results of testing undertaken with 120 V/60 Hz electromagnetic ballast. Block 166 of row 162 sets forth the results of testing a glow bottle used for starting a lamp. A test was done at −16° C. and 120 V. These parameters resulted in four strikes of the filament in a 3-second time period in order to start the lamp. At 108 V, 7 strikes were necessary in 5 seconds. When the input voltage was reduced to 96 V, the lamp could not be started.

Block 168, of row 162 shows a lamp was attempted to be started at 110° C., with a 120 V input. Under these conditions 5 strikes were necessary in three seconds to start the lamp, at 108 V, 8 strikes were necessary for 5 seconds to strike the lamp, and at 96 V, 15 strikes were necessary over a period of 7 seconds to start the lamp. These results may be compared with the results of row 164 for another 120 V/60 Hz ballast using an electronic starter according to the present invention.

Block 170 of row 164 shows the lamp started at −16° C. at 120 V and 108 V, both of which were successful instantaneous starts (before timeout occurred). It is noted that at 96 V input no starting of the lamp was achieved.

Block 172 of row 164 reports test results for operation parameters similar to those performed in block 170 at −10° C. In block 174 results of testing at +95° C., are reported and block 176 reports the results at 100° C.

Rows 178, 180 show the outcome of using the electronic starter of the present invention in connection with the 230 V/50 Hz ballast and a 277 V/60 Hz ballast. Row 182 lists further results of a glow bottle used in conjunction with a 277/V/60 Hz ballast at varying temperatures, and row 184 shows results for use of a glow bottle with a 230 V/50 Hz ballast.

Advance is a Registered trademark of North American Phillips Corporation; Tridonic is a registered trademark of Zutobel Aktiengesellschaft; and Robertson is a registered trademark of Robertson Worldwide dba/Robertson Transformers Co.

Turning attention to the specific component values and designations of an optimized circuit in accordance with the teachings of FIG. 3, below is a parts listing of a proposed embodiment for an electronic starter:

| | |
|---|---|
| Diode 104 | 1N4148; 10 V |
| Resistor 106 | 100K ohms |
| Zener Diode 106 | 10 V Zener, 6%, 500 mw |
| Resistor 108 | 2.4M ohms, ¼ w, 5% |
| Resistors 110, 142, 200, 202 | 100K ohm, 0.1 w, 5% |
| Resistor 130 | 100 ohm, 0.1 w, 5% |
| Resistor 122 | 2.4M ohms, 0.1 w, 5% |
| Resistor 128 | 1 ohm, ¼ w, 5% |
| Diode 204 | 1 amp, 1,000 V, 1N4007 |
| Transistor 120 | NPN, MMBT-3904(SMDSOT23) NPN, CMPT 3904) (SMDSOT23) |
| Transistor 126 | 600 V MOSFET (SSU1N60A, T0-251AA) (STD1NB60-1 TO-251-AA) |
| NAND gates 112, 114,116,118 | Quad, 2-input NAND-Schmidt trigger |
| Capacitor 206 | 0.022 micro-farads, 50 V, 10% |
| Capacitor 124 | 0.22 micro-farads, 10 V, 10%, |
| Capacitor 144 | 1 micro-farad, 10 V, 10% |
| Diode 140 | 1N4148 |
| Fuse 150 | 250 mA, 125 V fast-blow |

While the invention has been described with respect to specific embodiments by way of illustration, many modifications and changes will occur to those skilled in the art. It is therefore to be understood that the appended claims are intended to cover all such modifications and changes as fall within the true spirit and scope of the invention.

What is claimed is:

1. A lighting circuit comprising:

a line voltage source supplying a full wave signal, including first and second wave form portions, to the lighting circuit;

a ballast connected at a first end to the line voltage source;

a lamp having first and second cathodes, the first cathode connected to a second end of the ballast and the second cathode connected to the line voltage source; and an electronic starter connected across the lamp, the electronic starter including, a pulse generating circuit for generating a cathode current pulse, and a starter switch connected to the first and second cathodes of the lamp and connected to receive the cathode current pulse from the pulse generating circuit, wherein the pulse generating circuit acts to control the cathode current pulse delivered to the cathodes.

2. The invention according to claim 1 further including, a feedback circuit, connected to sense a cathode current delivered to the cathodes, wherein upon sensing a cathode current value at least equal to a predetermined value, the feedback circuit disables the electronic starter.

3. The invention according to claim 2 wherein the feedback circuit includes, a sensing circuit which senses the cathode current pulse delivered to the cathodes; and a feedback switch configuration connected to receive, from the sensing circuit, a signal representing the cathode current pulses, wherein the feedback switch is controlled dependent upon the signal received from the sensing device.

4. The invention according to claim 3 wherein the feedback circuit further includes, a latch circuit connected to the feedback switch, wherein upon receiving a predetermined current signal from the feedback switch, a state of the latch circuit is altered, disabling the electronic starter.

5. The invention according to claim 1 wherein the electronic starter is configured to cease providing cathode current pulses to the lamp once discharges of the lamp become self-sustaining.

6. The invention according to claim 1 further including a shutdown circuit connected to the pulse generating circuit, wherein the shutdown circuit acts to disable the electronic starter after a predetermined event.

7. The invention according to claim 6 wherein the predetermined event is at least one of a predetermined time period and a sensed current value.

8. The invention according to claim 7 further including, a discharge circuit connected to the shutdown circuit, whereby upon removal of the line voltage source a discharge path is provided for the shutdown circuit through the discharge circuit.

9. The invention according to claim 6 wherein the shutdown circuit includes, a shutdown device which during an active time period of the electronic starter has a first input at a constant value; and a shutdown timer network connected to a second input of the shutdown device, the shutdown timer network configured to alter the input to the second input of the shutdown device after a predetermined time period, wherein the shutdown circuit is activated to disable the electronic starter.

10. The invention according to claim 1 further including, a rectifying circuit which half wave rectifies the full wave signal, whereby a half wave rectified current pulse train is generated.

11. The invention according to claim 1 wherein the ballast is at least one of, a 120 v/60 hz ballast, a 277 v/60 hz ballast, a 347 v/60 hz ballast, and a 230 v/50 hz ballast.

12. The invention according to claim 1 wherein the pulse generating circuit includes, a pulse generating device which receives a first input from a shutdown circuit; and a pulse time out circuit which delivers its output to a second input of the pulse generating device, wherein prior to the shutdown circuit disabling the electronic starter, the output of the time out circuit controls generation of the cathode current pulse supplied to the lamp.

13. The invention according to claim 1 further including a fuse element located between the switch and the lamp.

14. The invention according to claim 1 wherein the lamp is a gas discharge lamp.

15. In a lighting circuit having a line voltage source, a ballast, a lamp, and an electronic starter connected across the lamp, the electronic starter comprising:

a pulse generating circuit for generating a cathode current pulse, a switch connected to first and second cathodes of the lamp, and connected to receive the cathode current pulse from the pulse generating circuit;

a rectifying circuit which half wave rectifies a full wave signal delivered by the line voltage source, wherein the pulse generating circuit acts to limit duration of the cathode current pulse delivered to the cathodes and wherein a shutdown circuit acts to disable the electronic starter after a predetermined event; and a feedback circuit connected to sense current delivered to the cathodes by the cathode current pulse, wherein upon sensing a current value at least equal to a predetermined value, the feedback circuit disables the electronic starter.

16. The invention according to claim 15 wherein the shutdown circuit is connected to the pulse generating circuit; and a discharge circuit is connected to the shutdown circuit, whereby upon removal of the line voltage source a discharge path is provided for the shutdown circuit through the discharge circuit.

17. The invention according to claim 15 wherein the ballast is at least one of a 120 V/60 Hz ballast, a 277 V/60 Hz ballast, a 347 V/60 Hz ballast, and a 230 V/50 Hz ballast.

18. The invention according to claim 16 wherein the shutdown circuit includes, a shutdown device which during an active time period of the electronic starter, has a first input at a constant value; and a shutdown timer network connected to a second input of the shutdown device, the shutdown timer network configured to alter the input to the second input of the shutdown device after a predetermined time period, wherein the shutdown circuit is activated to disable the electronic starter.

19. The invention according to claim 15 wherein the feedback circuit includes, a sensing circuit which senses the cathode current pulse delivered to the lamp; and a feedback switch configuration connected to receive, from the sensing device, a signal representing the lamp start pulse, wherein the feedback switch configuration is controlled dependent upon the signal received from the sensing device.

20. The invention according to claim 19 further including a latch circuit connected to the feedback switch, wherein upon receiving a predetermined signal from the feedback switch, a state of the latch circuit is altered, disabling electronic starter.

* * * * *